United States Patent [19]

Aigoo

[11] 4,445,281

[45] May 1, 1984

[54] DEHYDRATING DRIER

[76] Inventor: Seiichiro Aigoo, 15-13, Negishi 3-chome, Taito-ku, Tokyo 110, Japan

[21] Appl. No.: 339,521

[22] PCT Filed: Apr. 21, 1981

[86] PCT No.: PCT/JP81/00094

§ 371 Date: Dec. 18, 1981

§ 102(e) Date: Dec. 18, 1981

[30] Foreign Application Priority Data

Apr. 23, 1980 [JP] Japan ..... 55-52992
Jul. 30, 1980 [JP] Japan ..... 55-103639

[51] Int. Cl.[3] ..... F26B 11/18

[52] U.S. Cl. ..... 34/58; 34/69; 34/187; 361/213

[58] Field of Search ..... 361/229, 213, 230; 34/184, 187, 188, 8, 58, 69

[56] References Cited

U.S. PATENT DOCUMENTS 1,115,051 10/1914 Bonsall ..... 34/187
4,236,851 12/1980 Szasz ..... 406/72
4,333,123 6/1982 Moulden ..... 361/213

FOREIGN PATENT DOCUMENTS 312324 12/1955 Switzerland ..... 34/187

*Primary Examiner*—Larry I. Schwartz
*Attorney, Agent, or Firm*—Martin A. Farber

[57] ABSTRACT

A dehydrating drier is so arranged that the dehydrated and dried members in a thin form, such as silicon wafers, glass for liquid crystal, photo masking glass or lenses, are rotated with a rotor, and deflectors are disposed in a ventilation channel for a flow of drying gas which reaches the dehydrated and dried members. Preferably, the deflectors are disposed substantially concentrically to the ventilation channel. Furthermore, the improved dehydrating drier also includes an electricity remover for removing charged electricity on the members. In addition, high voltage electrodes of the electricity remover of an electric type are preferably disposed substantially concentrically to the ventilation channel upstream in the path of the flow of drying gas before reaching the members. In this manner, a dehydrating drier is provided such that with a simplified structure, drying gas uniformly hits all the members so as to achieve a uniformly dried condition, and a reduction in yield of the products or a deterioration in quality due to generation of static electricity is completely prevented.

11 Claims, 7 Drawing Figures

DEHYDRATING DRIER

DESCRIPTION

1. Technical Field

This invention relates to a dehydrating drier used for dehydrating and drying treated members in a thin form such as silicon wafers, glass for liquid crystal, photo masking glass or lenses.

2. BACKGROUND ART

The conventional dehydrating drier (FIG. 1) used for dehydrating and drying, after washing, silicon wafers, glass for liquid crystal, photo masking glass or lenses comprises a table-like rotor 3 in a housing 2, and a plurality of carrier holders 4 which are fixed to the rotor 3. The silicon wafers or others to be hydrated and dried are installed in a cage-like carrier and then this carrier is inserted into the carrier holder 4. In this state, when the rotor 3 is rotated at a high speed of 500~1500 r.p.m. with a power supply turned on, water drops adhering to the silicon wafers or the other members are splattered by centrifugal force, so that the silicon wafers or others will drain. Furthermore, drying gas suctioned by the action of negative pressure which is produced at the central portion due to rotation of the carrier holder 4 dries the surface of the silicon wafers or the other members.

In this prior dehydrating drier, however, the velocity and flow rate of the drying gas flowing on the respective silicon wafers or the other members are not uniform, so that all silicon wafers can not reach a uniformly dried state. Particularly, a drawback that has been experienced is that nonuniformity in drying will occur on a plurality of silicon wafers or other members which are positioned at upper regions in the drier.

Furthermore, in this prior dehydrating drier, the surface of the silicon wafers or the other members which rotate at a high speed together with the rotor is charged with electricity due to friction with the gas, whereby static electricity is produced. No countermeasure to cope with such charging of frictional electricity is provided, so that electrostatic breakdown will occur in the silicon wafers or the other members and dust may attach thereto due to the frictionally charged static electricity, thus resulting in a reduction in yield of the products or a deterioration in quality.

The present invention is a result of the foregoing situations as an improvement thereover and an object of this invention is to provide a dehydrating drier in which drying gas uniformly flows on all silicon wafers or other members so as to achieve a uniformly dried state and static electricity generated on the surface of the silicon wafers or the other members can be positively removed, with a simplified structure.

DISCLOSURE OF INVENTION

A dehydrating drier according to this invention comprises a housing, a plurality of water drop reflection preventing blades disposed in the housing, means comprising a rotor rotatably mounted in the housing at a position inside of the blades for supporting a plurality of thin form objects and for producing a negative pressure upon rotation, the rotor forms a ventilation channel communicating from an outside of the housing and the thin form objects and adapted for passage therethrough of a flow of drying gas from the outside to the thin form objects by the negative pressure produced upon rotation of the rotor, deflectors disposed in the ventilation channel, each of the deflectors comprises a cylindrical portion disposed in an upstream direction of the ventilation channel and a flange portion in a downstream direction of the ventilation channel with respect to the flow of the drying gas, and anti-static electricity means for generating a corona discharge into the ventilation channel and producing ions splattering into the flow of the drying gas, the anti-static electricity means is disposed on the flange portions of the deflectors.

Preferably, the deflectors are disposed concentrically with respect to the ventilation channel.

Furthermore, the improved dehydrating drier according to this invention also includes an electric electricity remover for removing the charged electricity on the dehydrated and dried members supported by the rotor.

In addition, high voltage electrodes of the electricity remover are preferably disposed concentrically to the ventilation channel for the flow of the drying gas reaching the dehydrated and dried members. By this, a dehydrating drier can be obtained such that with a simplified structure, drying gas flows on all silicon wafers or the other members uniformly so as to achieve a uniformly dried state, and completely prevents a reduction in yield of the products or a deterioration in quality due to the generation of static electricity.

With the above and other objects and advantages in view, the present invention will become more clearly understood in connection with the detailed description of preferred embodiments, when considered with the accompanying drawings, of which:

BEST MODE FOR CARRYING OUT THE INVENTION

Figure 1:
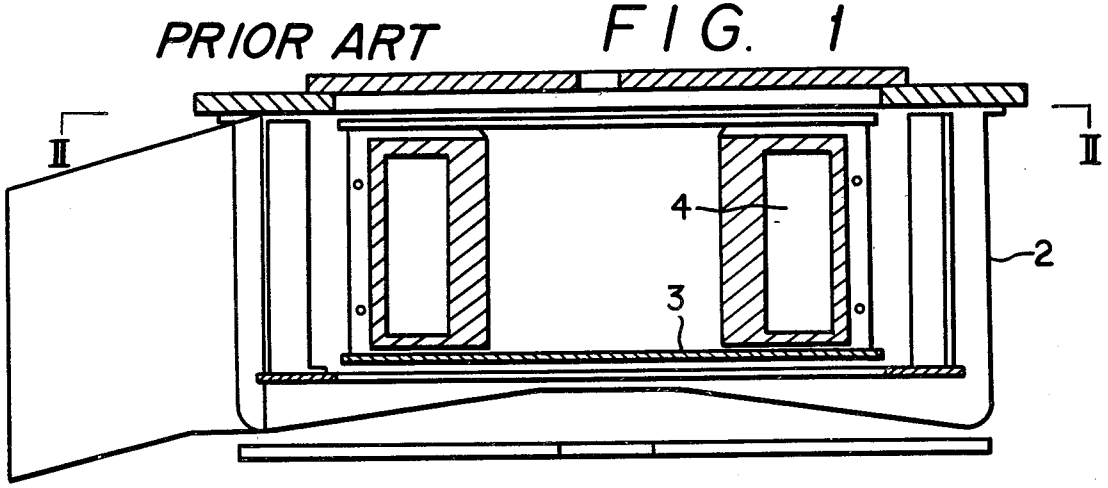
FIG. 1 PRIOR ART
FIG. 1 is a longitudinally sectional view of the prior dehydrating drier.
Figure 2:
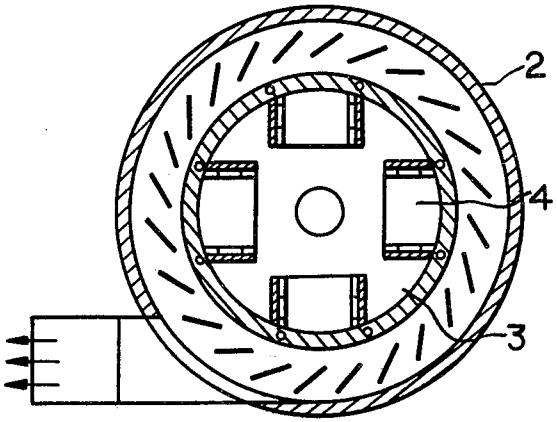
FIG. 2 PRIOR ART
FIG. 2 is a sectional view along the line II—II in FIG. 1.
Figure 3:
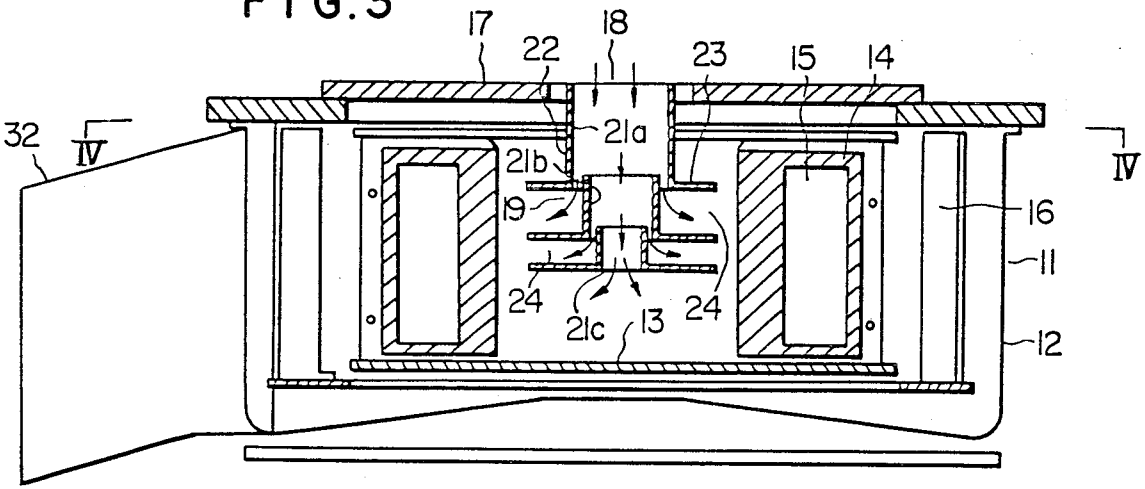
FIG. 3 is a longitudinally sectional schematic view showing one embodiment of a dehydrating drier according to this invention.
Figure 4:
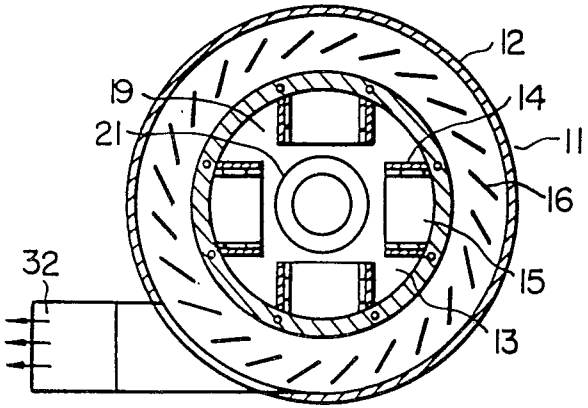
FIG. 4 is a sectional view along the line IV—IV in FIG. 3.
Figure 5:
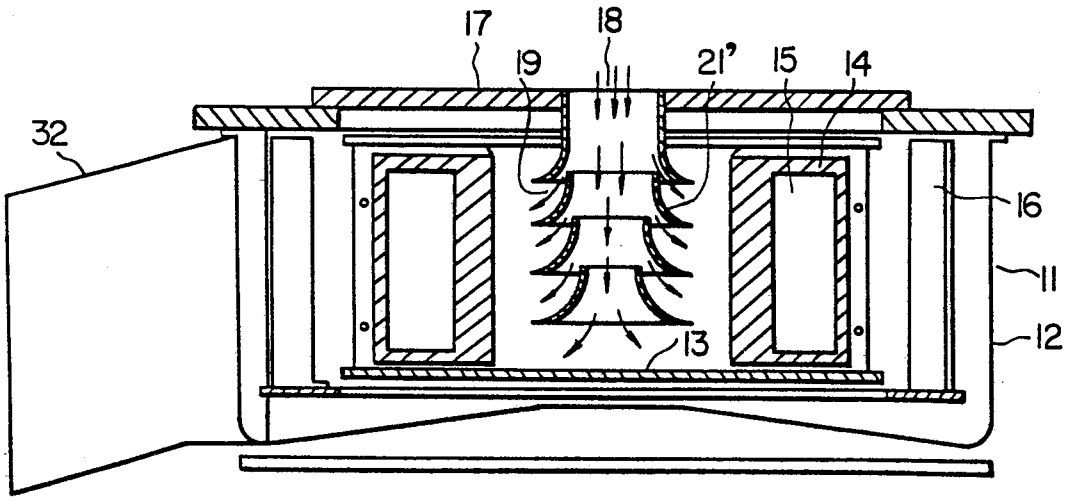
FIG. 5 is a longitudinally sectional view showing another embodiment of the dehydrating drier according to this invention.

Referring to FIGS. 3 and 4, a dehydrating drier 11 has a housing 12. A table-like rotor 13 is placed in the housing 12 and carrier supports 14 are mounted on the rotor 13. Wafer carriers 15 accommodating a number of wafers (not shown) are secured to and supported by the carrier supports 14 when the wafers are to be dehydrated and dried up. At the outer side of the rotor 13 and wafer supports 14, a plurality of reflection preventing blades 16 are disposed in the housing 12 outside of the rotor 13. A cover 17 capable of being opened or closed is provided at the upper end of the housing 12 and formed with an inlet port 18 coaxial to an axis of rotation of the rotor 13, the inlet port 18 having a mesh (not shown) stretched thereon. A deflecting unit 19 is positioned in a central ventilation channel communicating with the outside via the inlet port 18 and extending coaxially in the rotor 13 communicating with the wafers. The deflecting unit is attached at the inner side of the cover 17 substantially concentric to the inlet port 18. The deflecting unit 19 comprises a plurality of deflectors 21*a*, 21*b* . . . positioned concentrically to one another. Those deflectors 21*a*, 21*b* . . . are composed of respective cylindrical portions 22 and flanges 23 radially extending out from the lower end of the cylindrical portions 22. Respective cylindrical portions 22 of the deflectors 21*a*, 21*b* . . . have different diameters compared to one another and adjacent deflectors 21*a*, 21*b* . . . and are concentrically located overlapping at a part of their cylindrical portions, so that annular gaps are formed between adjacent deflectors. Each of these gaps constitutes a ventilation path 24. The deflectors 21 are also positioned coaxially to an axis of rotation of the rotor 13, and their sizes and positions are determined so as to allow drying gas to uniformly discharge into the outer side of the deflecting unit 19. Alternately, the deflecting unit 19 may comprise a plurality of inverted-funnel shaped deflectors 21' disposed concentrically to one another, as shown in FIG. 5.

Figure 6:
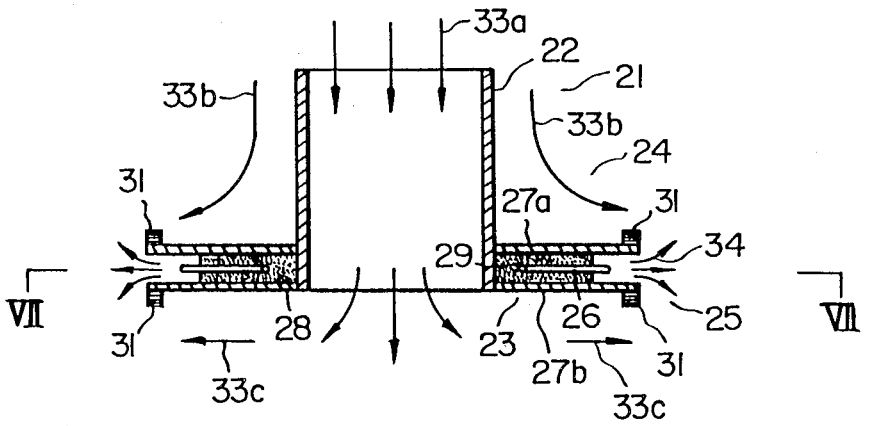
FIG. 6 is a longitudinal sectional view of the deflectors.
Figure 7:
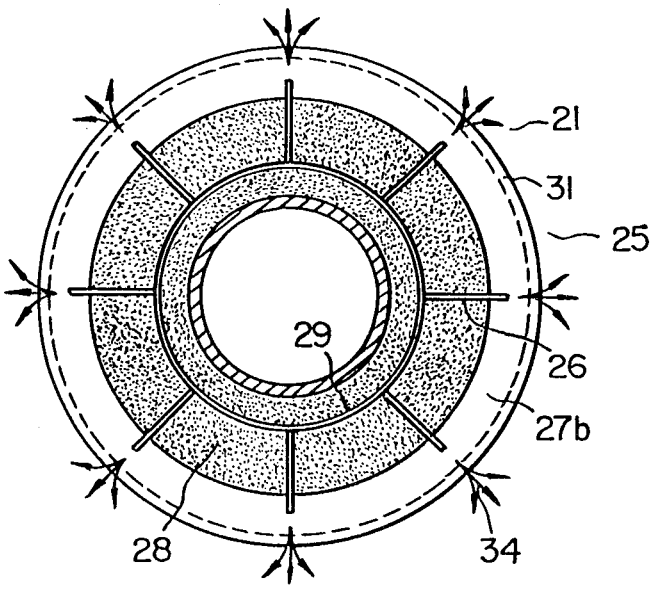
FIG. 7 is a sectional view along the lines VII—VII in FIG. 6.

As shown in FIGS. 6 and 7, an electricity remover 25 is fitted to the dehydrating drier 11. The electricity remover 25 comprises high voltage electrodes 26 and grounded electrodes 31. When high voltage is applied to the high voltage electrodes, corona discharge occurs generating positive or negative ions. The high voltage electrodes 26 are mounted on each flange 23 of the respective deflectors 21*a*,21*b* . . . . More specifically, each flange 23 of the deflectors 21*a*,21*b* . . . comprises two annular plates 27*a* and 27*b* spaced a predetermined distance apart. Protective insulators 28 are placed between the two annular plates 27*a* and 27*b*, and the high voltage electrodes 26 are radially positioned and imbedded in the protective insulators 28 in such a manner that the radially outer discharge end of each high voltage electrode projects out from the protective insulators 28. High voltage wiring 29 is connected with the proximal ends of the high voltage electrodes 26. Furthermore, the grounded electrodes 31 are disposed at the axially facing outer sides of the free ends of the annular plates 27*a* and 27*b*.

In the dehydrating unit 11, silicon wafers or other treated members are placed in the wafer carriers 15 and then each wafer carrier 15 is inserted in the respective carrier supports 14. Thereafter, the cover 17 is closed and the rotor 13 is rotated with the power supply turned on. When the rotor 13 starts to rotate, water drops adhering to the silicon wafers or the other members are thrown to the exterior of the rotor 13 due to the centrifugal force which is produced. In this manner the silicon wafers or the other members drain. Water drops splattering to the exterior of the rotor 13 are guided by the reflection preventing blades 16, and pass to an outlet port 32 from which they discharge out from the housing 12. In this manner the water drops will never be reflected in the direction toward the silicon wafers.

At the same time as the dehydrating process mentioned above is carried out with rotation of the rotor 13, negative pressure is produced at the rotational center of the rotor 13. By the negative pressure the drying gas, such as clean air or $N_2$ gas, flows into the rotational center of the rotor 13 from the exterior of the housing 12 via the inlet port 18 formed in the cover 17, impacts the silicon wafers which are rotated while being held by the carrier supports 14 and hence dries up the silicon wafers which have drained. Since the deflecting unit 19 is disposed at the rotational center of the rotor 13, the drying gas passing through the center portion is distributed by the deflectors 21 as shown by arrows 33*a*, 33*b*, 33*c* in FIG. 6 and the distribution of the velocity and flow rate of the drying gas becomes uniform in the rotational direction, thus enabling the uniformly dried state to be achieved on all the silicon wafers.

On the other hand, although the surface of the silicon wafers is charged with electricity due to contact with the drying gas, the high voltage applied on the high voltage electrodes 26 causes the corona discharge directed to the grounded electrodes 31 as shown by an arrow 34, so that positive or negative ions are generated in the drying gas. Those ions are carried with the flow of the drying gas passing thereby and reach to surface of the silicon wafers, thereby neutralizing and extinguishing electrostatic charges with opposite polarity on the silicon wafers. Therefore, when taking the silicon wafers out of the rotor after completion of the drying, there is no fear that electrostatic breakdown will occur or dust may attach to the silicons.

Although silicon wafers have been mentioned as the treated member and a dehydrating drier for silicon wafers has been explained as one example of application of this invention, it is to be understood that this invention is also applicable to other treated members in a thin form such as glass for liquid crystal, photo masking glass or lenses without any modification.

INDUTRIAL APPLICABILITY

In such a manner, this invention is suitable for dehydrating and drying products that have a thin form such as silicon wafers, glass for liquid crystal, photo masking glass or lenses, which require strict avoidance of nonuniformity in drying, of attachment of dust or charging of frictional electricity. Adoption of this invention permits an increase in the yield of products and an improvement in the quality thereof.

What is claimed is:

1. A dehydrating drier, comprising a housing, a plurality of water drop reflection preventing blades disposed in said housing, means comprising a rotor rotatably mounted in said housing at a position inside of said blades for supporting a plurality of thin form objects and for producing a negative pressure upon rotation, said rotor forms a ventilation channel communicating from an outside of said housing and said thin form objects and adapted for passage therethrough of a flow of drying gas from the outside to said thin form objects by said negative pressure produced upon rotation of said rotor, deflectors disposed in said ventilation channel, each of said deflectors comprises a cylindrical portion disposed in an upstream direction of said ventilation channel and a flange portion in a downstream direction of said ventilation channel with respect to said flow of said drying gas, and anti-static electricity means for generating a corona discharge into said ventilation channel and producing ions splattering into the flow of said drying gas, said anti-static electricity means is disposed on said flange portions of said deflectors.

2. The dehydrating drier according to claim 1, wherein said deflectors are of decreasing diameter, respectively, in the downstream direction and are positioned concentrically overlappingly in a telescopic arrangement defining annular gaps between adjacent of said deflectors adjacent the flange portion of an upstream of said adjacent deflectors and a cylindrical portion of the other of said adjacent deflectors.

3. The dehydrating drier according to claim 1, wherein said flange portions form radially outwardly curving inverted funnels curving convexly from said cylindrical portions.

4. The dehydrating drier according to claim 2, wherein said flange portions form radially outwardly curving inverted funnels curving convexly from said cylindrical portions.

5. The dehydrating drier according to claim 1, wherein said flange portion is an annular plate which extends radially from a downstream end of said cylindrical portion.

6. The dehydrating drier according to claim 2, wherein said flange portion is an annular plate which extends radially from a downstream end of said cylindrical portion.

7. The dehydrating drier according to claim 2, wherein said deflectors are coaxially disposed with respect to the axis of rotation of said rotor and the axis of said ventilation channel.

8. The dehydrating drier according to claim 1, further comprising carrier support means for holding the form objects and for being mounted in said rotor around and communicating said form objects with said ventilation channel.

9. The dehydrating drier according to claim 1, further comprising a removable cover for said housing forming said inlet opening, said deflectors are mounted at said cover.

10. The dehydrating drier according to claim 1, wherein each of said flange portions is formed of two axially spaced annular plates, and said anti-static electricity means comprises radial high voltage electrodes disposed between said plates insulated at raidally inner portions of said electrodes and cooperating grounded electrodes disposed on axially facing outer sides of said plates.

11. The dehydrating drier according to claim 10, wherein said high voltage electrodes and said ground electrodes are uniformly distributed around said plates.

* * * * *